US010343753B1

(12) United States Patent
Santa-Torres

(10) Patent No.: US 10,343,753 B1
(45) Date of Patent: Jul. 9, 2019

(54) SWIMMING SAFETY TETHER

(71) Applicant: Luis Santa-Torres, Fredericksburg, VA (US)

(72) Inventor: Luis Santa-Torres, Fredericksburg, VA (US)

( * ) Notice: Subject to any disclaimer, the term of this patent is extended or adjusted under 35 U.S.C. 154(b) by 0 days.

(21) Appl. No.: 16/031,074

(22) Filed: Jul. 10, 2018

(51) Int. Cl.
*B63C 9/26* (2006.01)
*G08B 7/02* (2006.01)
*G08B 21/02* (2006.01)

(52) U.S. Cl.
CPC ..... *B63C 9/26* (2013.01); *G08B 7/02* (2013.01); *G08B 21/02* (2013.01)

(58) Field of Classification Search
CPC ..... B63C 9/26; G08B 7/02; G08B 21/02
See application file for complete search history.

(56) References Cited

U.S. PATENT DOCUMENTS 3,981,500 A * 9/1976 Ryan ..... A61G 7/0533 248/274.1
4,095,657 A * 6/1978 Hohwart ..... A63B 69/12 434/254
4,247,096 A * 1/1981 Schmitt ..... A63B 69/12 273/DIG. 30
4,530,497 A * 7/1985 Moran ..... A63B 69/12 434/254
5,158,513 A * 10/1992 Reeves ..... A63B 21/154 434/254
5,367,721 A * 11/1994 Boyles ..... A61G 7/1005 4/496
5,391,080 A * 2/1995 Bernacki ..... A63B 69/12 434/254
5,766,114 A 6/1998 Campbell
5,846,167 A * 12/1998 Liu ..... A63B 69/12 482/55
D451,569 S 12/2001 Marx
6,935,911 B1 * 8/2005 Stewart ..... B63C 9/21 441/81
7,175,569 B1 * 2/2007 Lan ..... A63B 69/12 434/254
7,185,598 B1 * 3/2007 Lan ..... A63B 69/12 114/215
7,273,444 B2 * 9/2007 Chang ..... A63B 69/12 434/254
8,007,410 B2 8/2011 Mayaud
D687,115 S * 7/2013 Mayaud ..... D21/804
8,641,580 B2 * 2/2014 Bellerive ..... A63B 31/00 434/254

(Continued)

FOREIGN PATENT DOCUMENTS

DE 102016201242 8/2017

*Primary Examiner* — S. Joseph Morano
*Assistant Examiner* — Jovon E Hayes
(74) *Attorney, Agent, or Firm* — Kyle A. Fletcher, Esq.

(57) ABSTRACT

The swimming safety tether is lifesaving support for a swimmer. The swimming safety tether provides a rope suspended from an arm over a swimming pool. The rope passes through the pull switch of an alarm and provides a number of gripping points that the swimmer may grasp. A swimmer needing assistance may grasp the rope and pull. The force on the rope may trigger the alarm to produce visual and audible indications of distress. The swimmer may attempt to pull themselves to safety using the rope while the visual and audible indications attempt to attract assistance.

16 Claims, 4 Drawing Sheets

(56) References Cited

U.S. PATENT DOCUMENTS

| | | | | |
|---|---|---|---|---|
| 9,604,088 | B2 * | 3/2017 | Djang | A63B 69/12 |
| 2003/0001057 | A1 * | 1/2003 | Sweere | A47B 21/00<br>248/276.1 |
| 2004/0157514 | A1 * | 8/2004 | Courtney | B63C 9/081<br>441/88 |
| 2014/0155227 | A1 * | 6/2014 | Bellerive | A63B 69/12<br>482/55 |
| 2015/0290517 | A1 * | 10/2015 | Saleh | A63B 69/12<br>434/254 |

* cited by examiner

SWIMMING SAFETY TETHER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of pool safety equipment, more specifically, a swimming safety tether.

SUMMARY OF INVENTION

The swimming safety tether is lifesaving support for a swimmer. The swimming safety tether provides a rope suspended from an arm over a swimming pool. The rope passes through the pull switch of an alarm and provides a number of gripping points that the swimmer may grasp. A swimmer needing assistance may grasp the rope and pull. The force on the rope may trigger the alarm to produce visual and audible indications of distress. The swimmer may attempt to pull themselves to safety using the rope while the visual and audible indications attempt to attract assistance.

An object of the invention is to provide a rope suspended from a support arm above a swimming pool for a swimmer in distress to use.

Another object of the invention is to provide visual and audible indications that the swimmer has pulled on the rope.

A further object of the invention is to provide a pivot joint so that the support arm can be moved out of the way when not in use.

Yet another object of the invention is to provide gripping points along the rope so that the swimmer's hand so not slip on the rope while pulling.

These together with additional objects, features and advantages of the swimming safety tether will be readily apparent to those of ordinary skill in the art upon reading the following detailed description of the presently preferred, but nonetheless illustrative, embodiments when taken in conjunction with the accompanying drawings.

In this respect, before explaining the current embodiments of the swimming safety tether in detail, it is to be understood that the swimming safety tether is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the swimming safety tether.

It is therefore important that the claims be regarded as including such equivalent construction insofar as they do not depart from the spirit and scope of the swimming safety tether. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
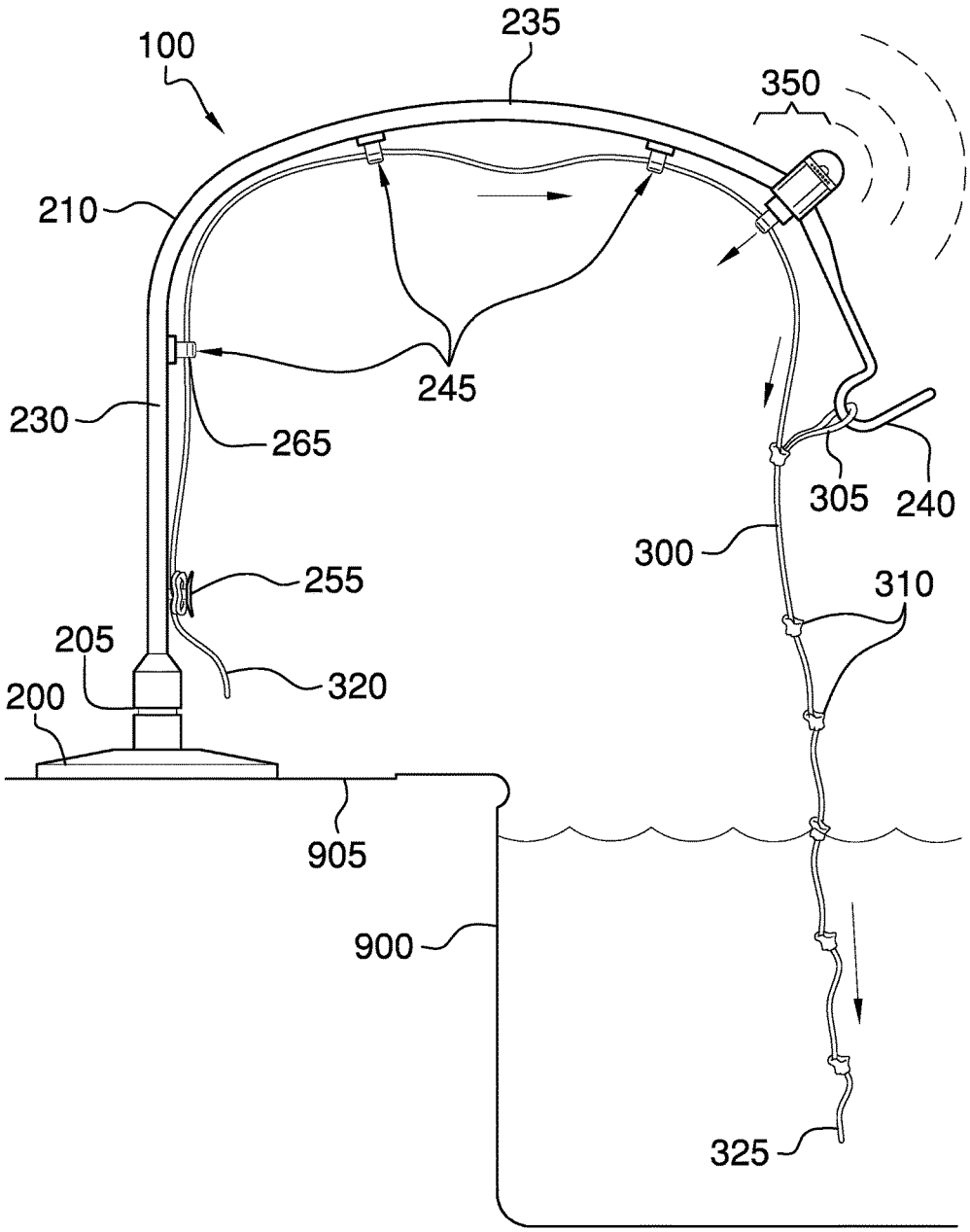
FIG. 1 is a front view of an embodiment of the disclosure.
Figure 2:
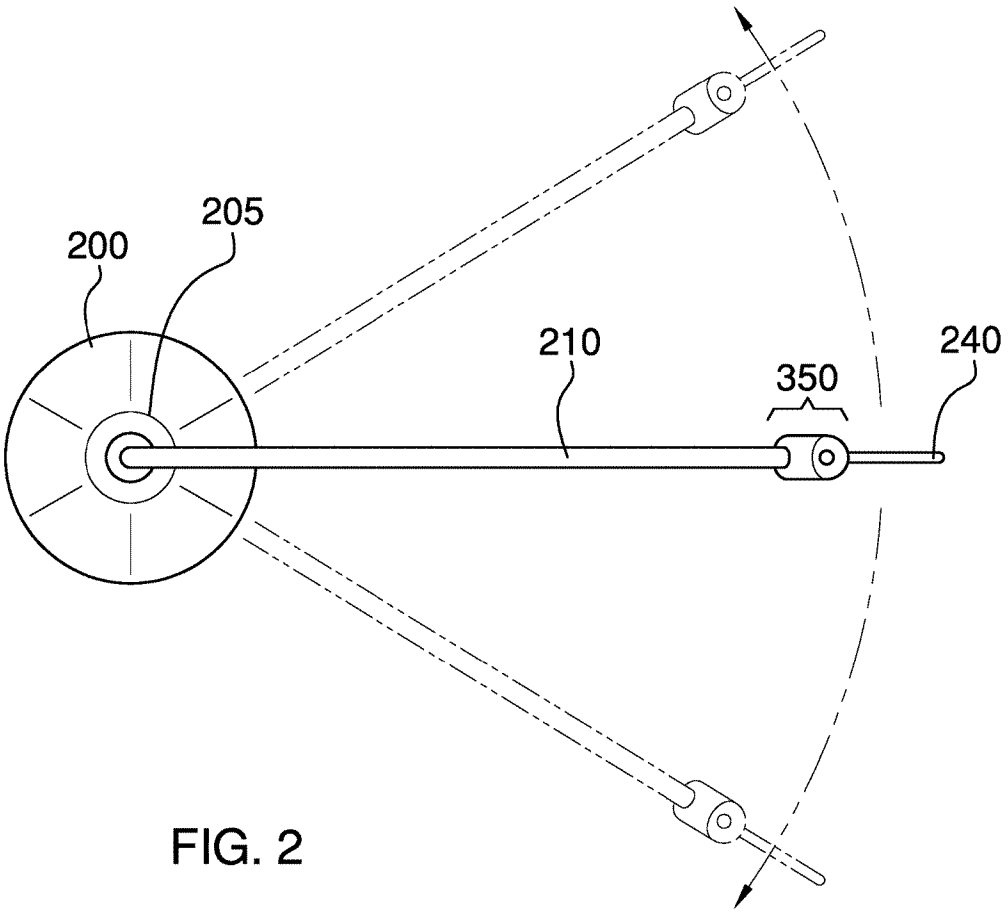
FIG. 2 is a top view of an embodiment of the disclosure.
Figure 3:
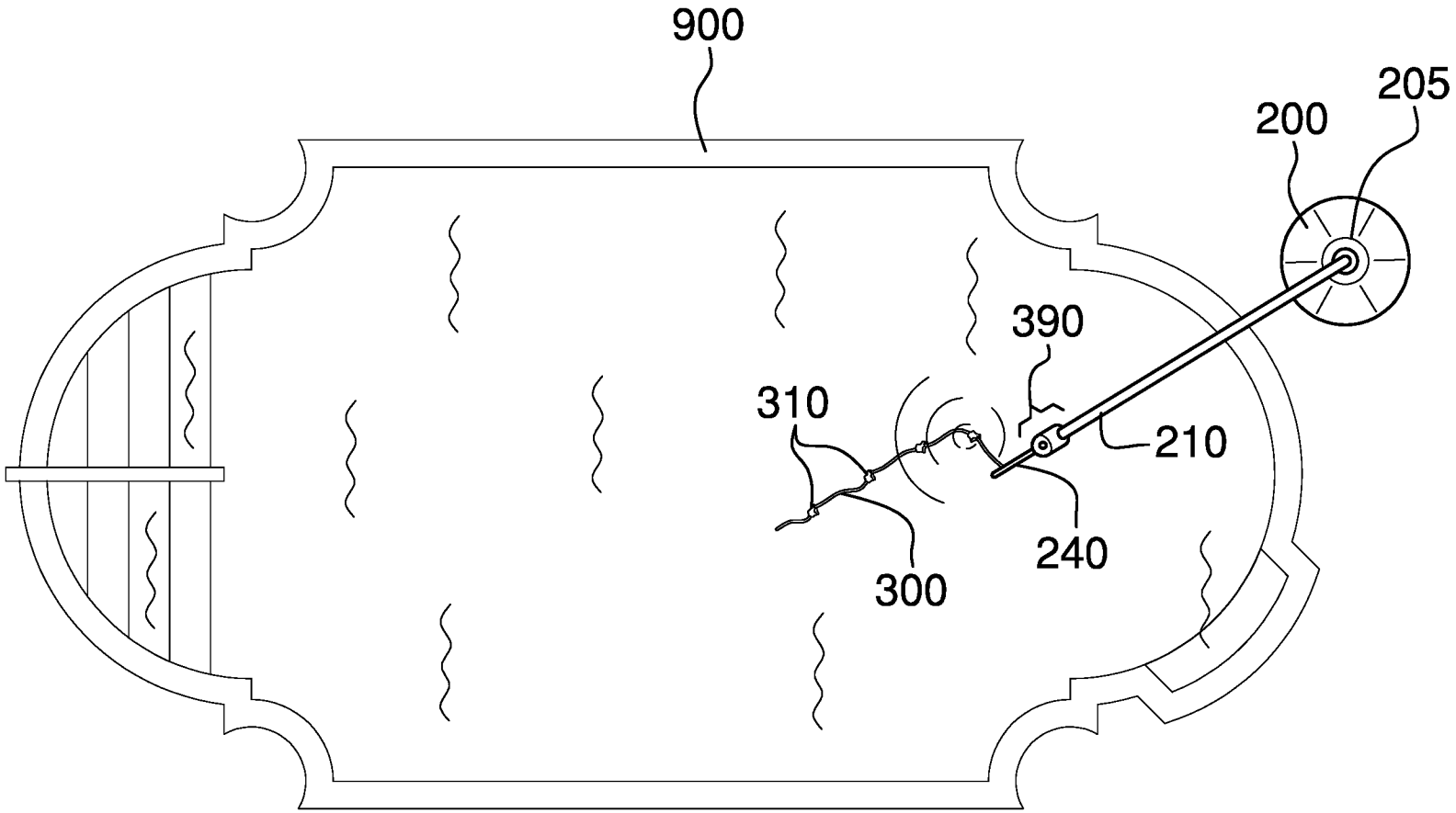
FIG. 3 is an in-use view of an embodiment of the disclosure illustrating the invention in use at a swimming pool.
Figure 4:
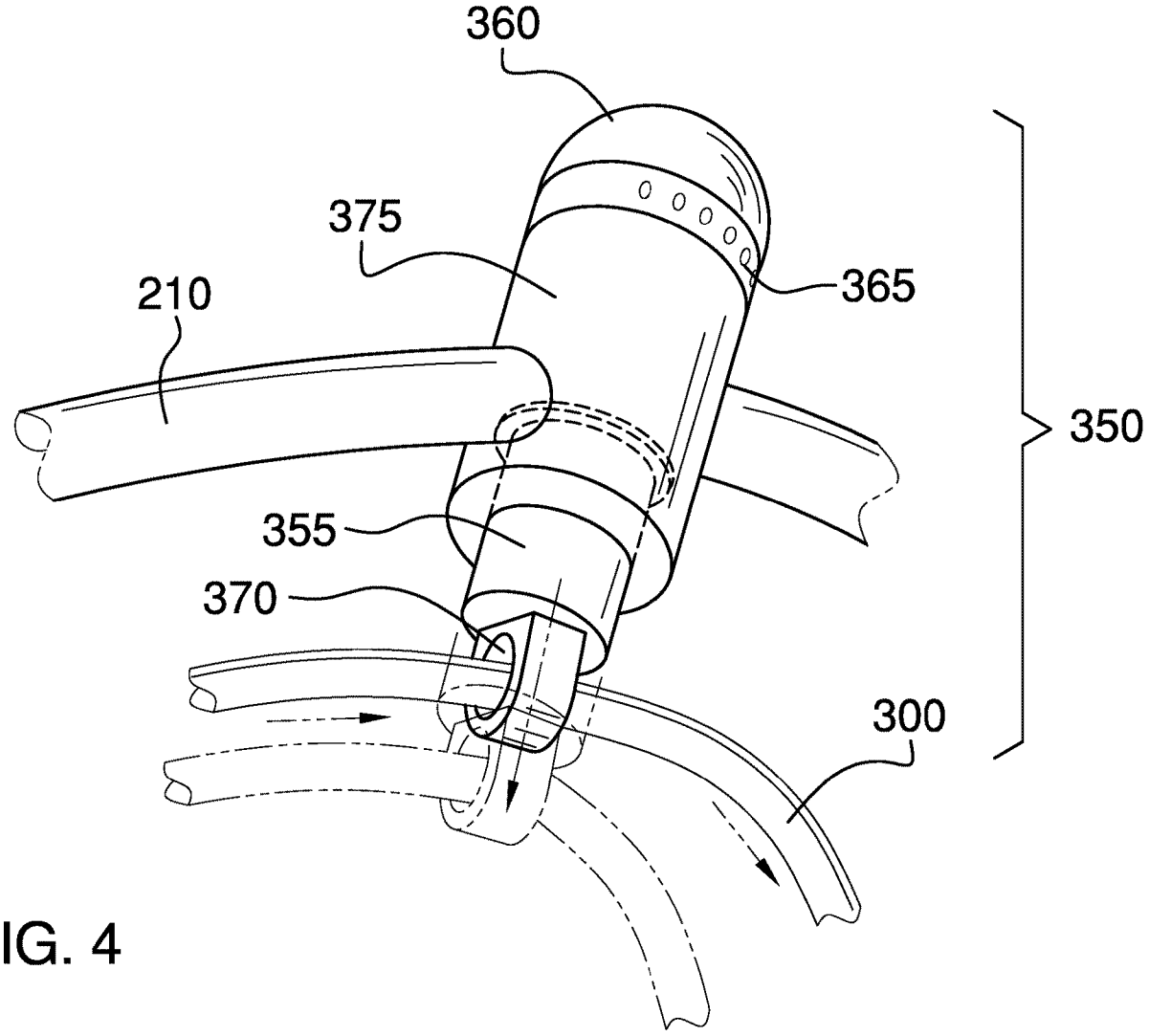
FIG. 4 is a detail view of an embodiment of the disclosure illustrating the alarm.

Detailed reference will now be made to a first potential embodiment of the disclosure, which is illustrated in FIGS. 1 through 4.

The swimming safety tether 100 (hereinafter invention) comprises a base 200, a pivot joint 205, a support arm 210, a rope 300, and an alarm 350. The invention 100 is a lifesaving support for a swimmer 920. The support arm 210 may be rotated into position above a pool 900 and the rope 300 suspended from the support arm 210 may be used by the swimmer 920 to pull themselves to safety.

The base 200 may be a pedestal for mounting the invention 100 next to the pool 900. As a non-limiting example, the base may bolt to a walkway 905 with the bolts covered by a decorative cover. The top center of the base 200 may couple to the pivot joint 205.

The pivot joint 205 may be a pivoting coupling between the base 200 and the support arm 210. The pivot joint 205 may allow the azimuth angle of the support arm 210 to change while the base 200 remains fixed to the walkway 905 adjacent to the pool 900. The pivot joint 205 may allow the invention 100 to be pivoted out of the way when not needed and pivoted into position above the pool 900 when in use.

The support arm 210 may be an armature that holds the rope 300 in a position above the pool 900 when the invention 100 is in use. The support arm 210 may comprise an upright 230, an arch 235, a hook 240, a cleat 255, and a plurality of rope guides 245. The upright 230 may be adapted to provide vertical height to place the arch 235 above the heads of the swimmers 920. The arch 235 extends the support arm 210 horizontally from the top of the upright 230 to the hook 240 at a point above the pool 900. The hook 240 may be a bend in the end of the arch 235 that is above the pool 900. The hook 240 may retain the rope 300.

The cleat 255 may be coupled to the bottom half of the upright 230. The cleat 255 may be a T-shaped retainer to which one end of the rope 300 is attached. The plurality of rope guides 245 may be standoffs mounted to the upright 230 and the arch 235. Each an individual rope guide 250 selected from the plurality of rope guides 245 comprises a guide aperture 265 through which the rope 300 may be strung. The plurality of rope guides 245 may be coupled to the pool side of the upright 230 and to the underside of the arch 235.

The rope 300 may be a group of yarns, fibers, plies, or strands that are twisted or braided together. The rope 300 may be composed of natural or synthetic materials. The rope 300 may be used by the swimmer 920 to pull themselves to the surface of the pool 900, to a side of the pool 900, or to a shallow end of the pool 900.

The rope 300 may comprise a loop 305 at a midpoint of the rope 300. As a non-limiting example, the loop 305 may be an overhand knot tied using a bight of the rope 300. The loop 305 may be placed over the hook 240 at the end of the support arm to support the rope 300 above the pool 900. A first end 320 of the rope 300 may be passed through the plurality of rope guides 245 such that the rope 300 parallels the support arm 210 from the hook 240 to the cleat 255. The first end 320 of the rope 300 may be coupled to the cleat 255. As a non-limiting example, the first end 320 of the rope 300 may be wrapped repeatedly around the cleat 255. A second end 325 of the rope 300 may be placed into the pool 900.

The rope 300 may comprise gripping points 310 located between the loop 305 and the second end 325 of the rope 300. As a non-limiting example, the gripping points 310 may comprise overhand knots tied at multiple locations along the rope 300. As a non-limiting example, the gripping points 310 may be substantially equally-spaced along the rope 300 and may be separated from each other by a distance of five feet or less. The gripping points 310 may provide non-slip traction points along the length of the rope 300.

The alarm 350 comprises an alarm enclosure 375, a pull switch 355, a visual indicator 360, and an audible indicator 365. The alarm 350 may be activated by the swimmer 920 when the swimmer 920 pulls on the rope 300.

The alarm enclosure 375 may be a housing for the pull switch 355, the visual indicator 360, and the audible indicator 365. The alarm enclosure 375 may couple to the arch 235. In some embodiments, the alarm enclosure 375 may be cylindrical with the pull switch 355 coupled to the bottom of the alarm enclosure 375, a transparent hemisphere on the top to cover the visual indicator 360, and the audible indicator 365 located just below the visual indicator 360. The alarm 350 may be coupled to the arch 235 between the hook 240 and the plurality of rope guides 245. The rope 300 may pass through a rope aperture 370 on the pull switch 355.

The pull switch 355 comprises the rope aperture 370. The rope 300 may pass through the rope aperture 370 such that when the second end 325 of the rope 300 is pulled down the pull switch 355 is triggered. When the pull switch 355 is triggered, the alarm 350 may be activated. When the alarm 350 is activated, the visual indicator 360 may flash at a predetermined interval, the audible indicator 365 may produce an audible sound, or both. The alarm 350 may remained activated until reset. As a non-limiting example, resetting the alarm 350 may involved pushing the pull switch 355 back to its original position.

The visual indicator 360 may be a light source. As non-limiting examples, the visual indicator 360 may be one or more LEDs, one or more incandescent bulbs, one or more strobe lamps, or combinations thereof.

The audible indicator 365 may be a source of audible sound. As non-limiting examples, the audible indicator 365 may be one or more loudspeakers, one or more buzzers, one or more piezoelectric sound transducers, or combinations thereof.

In some embodiments, the alarm 350 may be powered by one or more batteries (not illustrated in the figures). The one or more batteries may comprise one or more energy-storage devices. The one or more batteries may be a source of electrical energy to operate the pull switch 355, the visual indicator 360, and the audible indicator 365. The one or more batteries may be replaceable or rechargeable.

In use, the base 200 is mounted to the walkway 905 next to the pool 900 with the support arm 210 extending up and towards the pool 900. The rope 300 may be installed by hanging the loop 305 over the hook 240 and passing the first end 320 of the rope 300 through the rope aperture 370 on the alarm 350 and through the plurality of rope guides 245. When the first end 320 reaches the cleat 255, the rope 300 may be lashed to the cleat 255. The invention 100 may be pivoted above the pivot joint 205 such that the arch 235 is out of the way and not above the pool 900. The second end 325 of the rope 300 may be coiled on the walkway 905 next to the base 200 until needed.

If the swimmer 920 experiences trouble swimming, the second end 325 of the rope 300 can be thrown into the pool 900 targeted to land adjacent to the swimmer 920. The swimmer 920 may reach out and grasp the rope 300 and use the rope 300 to pull themselves to safety. As the swimmer 920 pulls on the rope 300, they may trigger the pull switch 355 on the alarm 350 and may activate the alarm 350. Activating the alarm 350 may result in flashing of the visual indicator 360 and an audible alert sounded by the audible indicator 365.

Alternatively, if the swimmer 920 will be alone, the invention 100 may be pivoted such that the hook 240 is above the pool 900 and the second end 325 of the rope 300 may be thrown into the pool 900. If the swimmer 920 experiences trouble swimming, the swimmer 920 may reach out and grasp the rope 300 and use the rope 300 to pull themselves to safety, possibly activating the alarm 350 in the process.

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, an "aperture" is an opening in a surface. Aperture may be synonymous with hole, slit, crack, gap, slot, or opening.

As used in this disclosure, the "azimuth" or azimuth angle, refers to an angle that is measured in a plane that is perpendicular to the either the vertical direction or the force of gravity.

Throughout this document the terms "battery", "battery pack", and "batteries" may be used interchangeably to refer to one or more wet or dry cells or batteries of cells in which chemical energy is converted into electricity and used as a source of DC power. References to recharging or replacing batteries may refer to recharging or replacing individual cells, individual batteries of cells, or a package of multiple battery cells as is appropriate for any given battery technology that may be used. The battery may require electrical contacts, which may not be illustrated in the figures.

As used in this disclosure, a "bight" refers to a loop of rope or line.

As used in this disclosure, a "cleat" is an object around which a rope, cord, or wire can be secured.

As used herein, the words "couple", "couples", "coupled" or "coupling", refer to connecting, either directly or indirectly, and does not necessarily imply a mechanical connection.

As used in this disclosure, "decorative" is an adjective that refers to a first object or item that is used with a second object or item of the purpose of making the second object or item more attractive. Decorative will generally, but not necessarily, imply making the second object or item more attractive visually.

As used herein, "front" indicates the side of an object that is closest to a forward direction of travel under normal use of the object or the side or part of an object that normally presents itself to view or that is normally used first. "Rear" or "back' refers to the side that is opposite the front.

As used in this disclosure, a "hook" is an object that is curved or bent at an angle such that items can be hung on or caught by the object or such that the object may be suspended from another object.

As used in this disclosure, a "housing" is a rigid casing that encloses and protects one or more devices.

As used in this disclosure, a "knot" is an interlacement of cord, ribbon, rope, or similar materials that is used to: 1) secure the cord, ribbon, rope, or other similar material to an object which may include, but is not limited to, a second cord, ribbon, rope, or other similar material; or, 2) prevent the cord, ribbon, rope, or other similar material from being pulled through a hole or out of a retaining device. The second type of knot may be referred to as a stopper knot.

As used here, the word "midpoint" refers to a point near the center of an object. An "exact midpoint" refers to a midpoint that is equidistant from edges of the object in at least one direction. Unless otherwise stated, a midpoint is not required to be at the exact center of the object but instead may be within 50% of the distance from the exact midpoint to the farthest edge.

As used herein, the word "pivot" is intended to include any mechanical arrangement that allows for rotational motion. Non-limiting examples of pivots may include hinges, holes, posts, dowels, pins, points, rods, shafts, balls, and sockets, either individually or in combination.

As used herein, the word "substantially" indicates that two or more attributes are the same except for a margin of error related to variances in materials, manufacturing processes, craftsmanship, installation, environmental conditions, or other factors that may influence the attributes and that the differences introduced by these factors are not considered detrimental to the operation of the invention as described herein.

As used in this disclosure, a "switch" is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch, respectively. Completing or interrupting an electric circuit is also referred to as making or breaking the circuit, respectively.

As used in this disclosure, a "tether" is a cord, line, webbing, or strap that is attached to an object to restrict movement.

As used in this disclosure, "transparent" refers to a material that allows light to pass through the material without significant scattering such that an object can be clearly seen through the material.

As used in this disclosure, "vertical" refers to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 4, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A swimming safety tether comprising:

a base, a pivot joint, a support arm, a rope, and an alarm;

wherein the swimming safety tether is a lifesaving support for a swimmer;

wherein the support arm is rotated into position above a pool and the rope suspended from the support arm is used by the swimmer to pull themselves to safety;

wherein the base is a pedestal for mounting the swimming safety tether next to the pool;

wherein the top center of the base couples to the pivot joint;

wherein the pivot joint is a pivoting coupling between the base and the support arm;

wherein the pivot joint allows the azimuth angle of the support arm to change while the base remains fixed to a walkway adjacent to the pool;

wherein the pivot joint allows the swimming safety tether to be pivoted out of the way when not needed and pivoted into position above the pool when in use;

wherein the support arm is an armature that holds the rope in a position above the pool when the swimming safety tether is in use;

wherein the support arm comprises an upright, an arch, a hook, a cleat, and a plurality of rope guides;

wherein the upright is adapted to provide vertical height to place the arch above the heads of the swimmers.

2. The swimming safety tether according to claim 1 wherein the arch extends the support arm horizontally from the top of the upright to the hook at a point above the pool.

3. The swimming safety tether according to claim 2 wherein the hook is a bend in the end of the arch that is above the pool;

wherein the hook retains the rope.

4. The swimming safety tether according to claim 3
wherein the cleat is coupled to the bottom half of the upright;
wherein the cleat is a T-shaped retainer to which one end of the rope is attached;
wherein the plurality of rope guides are standoffs mounted to the upright and the arch;
wherein each an individual rope guide selected from the plurality of rope guides comprises a guide aperture through which the rope is strung;
wherein the plurality of rope guides are coupled to the pool side of the upright and to the underside of the arch.

5. The swimming safety tether according to claim 4
wherein the rope is a group of yarns, fibers, plies, or strands that are twisted or braided together;
wherein the rope is composed of natural or synthetic materials;
wherein the rope is used by the swimmer to pull themselves to the surface of the pool, to a side of the pool, or to a shallow end of the pool.

6. The swimming safety tether according to claim 5
wherein the rope comprises a loop at a midpoint of the rope;
wherein the loop is placed over the hook at the end of the support arm to support the rope above the pool;
wherein a first end of the rope is passed through the plurality of rope guides such that the rope parallels the support arm from the hook to the cleat;
wherein the first end of the rope is coupled to the cleat;
wherein a second end of the rope is placed into the pool.

7. The swimming safety tether according to claim 6
wherein the rope comprises gripping points located between the loop and the second end of the rope.

8. The swimming safety tether according to claim 7
wherein the gripping points comprise overhand knots tied at multiple locations along the rope;
wherein the gripping points provide non-slip traction points along the length of the rope.

9. The swimming safety tether according to claim 8
wherein the alarm comprises an alarm enclosure, a pull switch, a visual indicator, and an audible indicator;
wherein the alarm is activated by the swimmer when the swimmer pulls on the rope.

10. The swimming safety tether according to claim 9
wherein the alarm enclosure is a housing for the pull switch, the visual indicator, and the audible indicator;
wherein the alarm enclosure couples to the arch.

11. The swimming safety tether according to claim 10
wherein the alarm enclosure is cylindrical with the pull switch coupled to the bottom of the alarm enclosure, a transparent hemisphere on the top to cover the visual indicator, and the audible indicator located just below the visual indicator;
wherein the alarm is coupled to the arch between the hook and the plurality of rope guides;
wherein the rope passes through a rope aperture on the pull switch.

12. The swimming safety tether according to claim 11
wherein the pull switch comprises the rope aperture;
wherein the rope passes through the rope aperture such that when the second end of the rope is pulled down the pull switch is triggered;
wherein the alarm is activated when the pull switch is triggered;
wherein when the alarm is activated, the visual indicator flashes at a predetermined interval, the audible indicator produces an audible sound, or both.

13. The swimming safety tether according to claim 12
wherein the visual indicator is a light source.

14. The swimming safety tether according to claim 13
wherein the visual indicator is one or more LEDs, one or more incandescent bulbs, one or more strobe lamps, or combinations thereof.

15. The swimming safety tether according to claim 14
wherein the audible indicator is a source of audible sound.

16. The swimming safety tether according to claim 15
wherein the audible indicator is one or more loudspeakers, one or more buzzers, one or more piezoelectric sound transducers, or combinations thereof.

* * * * *